United States Patent [19]

Anderson et al.

[11] 4,408,985

[45] Oct. 11, 1983

[54] METHOD OF FIXING HAZARDOUS SUBSTANCES IN WASTE FOUNDRY SAND

[76] Inventors: Mark A. Anderson, Rte. 1 Box 275, Graham, Ala. 36263; Robert W. Balliett, 330 Harland Rd., Norwich, Conn. 06360; Paul E. Link, Rte. 1 Box 518-C, Safford, Ariz. 85546; Donald P. Satchell, P.O. Box 1258, Morenci, Ariz. 85540

[21] Appl. No.: 301,459

[22] Filed: Sep. 14, 1981

[51] Int. Cl.[3] ..... F27B 14/00; B28B 7/36; B28C 5/06

[52] U.S. Cl. ..... 432/1; 106/38.2; 164/5; 366/4; 432/13

[58] Field of Search ..... 432/1, 13; 366/4, 7; 164/5, 456; 106/38.2

[56] References Cited

U.S. PATENT DOCUMENTS

| | | | |
|---|---|---|---|
| 2,384,573 | 9/1945 | Smith | 366/4 |
| 2,821,375 | 1/1958 | Andrews | 164/5 |
| 3,400,916 | 9/1968 | Troy et al. | 366/4 |
| 4,130,436 | 12/1978 | Hauser et al. | 164/5 |
| 4,144,088 | 3/1979 | Adams | 164/5 |

*Primary Examiner*—John J. Camby

[57] ABSTRACT

A method is disclosed for fixing certain dangerous substances into recyclable waste foundry sand so that they are less likely to leach out into the environment. The method uses a roasting process which causes the dangerous substances to form insoluble compounds with the sand. One example is shown where hazardous waste foundry sand which contains acetic acid soluble lead contamination is treated by this method. In this example the lead is believed to react with the sand during the roasting process forming compounds such as lead silicate which are insoluble to acetic acid. The amount of lead which may be leached out into the environment is reduced to a safe level according to the currently accepted test methods promulgated by the U.S. Environmental Protection Agency. The method may be applied to the conversion of waste foundry sand into reusable sand or landfill which are less likely to leach dangerous substances into the environment.

7 Claims, No Drawings

METHOD OF FIXING HAZARDOUS SUBSTANCES IN WASTE FOUNDRY SAND

BACKGROUND OF THE INVENTION

Sand is used in metal foundries for casting metal into desired shapes. The sand casting process of shaping metal objects is ancient. The sand used in the sand casting process is selected and treated according to a wide variety of requirements relating to the type of metal and object being cast. Often some of the sand is treated with resins, which along with moisture, provide a consistency that is needed to maintain the requisite shapes within the molds into which the molten metal is poured. The grain sizes porosity, and chemical makeup of the sand are all factors which affect the quality of castings.

Sand may be reused many times in a sand casting foundry. As it is used it becomes progressively contaminated with certain impurities which include constituents of the metal being cast, chemical reaction products of the resin additives, water, air, the cast metal and the sand itself. At some point its characteristics change sufficiently that it must be discarded and replaced with a fresh supply of sand. The discarded sand is a waste product which contains impurities which may include resins, metals, and reaction products of these with environmental elements.

The impurities in waste foundry sand may be leached out into the natural environment where they may be hazardous. Rain and its action together with organic acids natural to the environment may dissolve certain of these impurities and cause them to become contaminants in local water supplies.

In brass and bronze casting foundries, lead becomes a hazardous contaminant in the waste sand since it is a component of many alloys commonly used for casting.

Waste foundry sand at a brass casting foundry, for example, will typically contain approximately 3000 ppm (parts per million, by weight) more or less of lead, of which approximately 600 ppm may be soluble in aqueous solutions of acetic acid. Under conditions designed by the U.S. Environmental Protection Agency (EPA) to simulate the natural environment, the leachate from such waste foundry sand will typically contain approximately 30 ppm, more or less, of lead. The simulation conditions specified by the EPA standard test require leaching with an aqueous acetic acid solution with a pH of $5.0 \pm 0.2$. This is designed to simulate naturally occuring acidic water which may form from the action of rain and ground water on the environment. Using this standard test, samples of leachate from waste foundry sand at the Phelps Dodge, Lee Brothers Brass Foundry in Anniston, Ala. were found to contain 14,28,33 and 37 ppm, respectively, of lead.

The Environmental Protection Agency designates a waste material as hazardous if it exceeds 5 ppm of acetic acid soluble lead leached by its standard test solution. This is set forth in Federal Regulation CFR 40 Section 132.0102, Mar. 11, 1980.

The invention relates to a method of treating the waste sand so that its acetic acid soluble lead can be reduced to a safe level, below 5 ppm.

Prior efforts to reduce the lead content of waste materials are directed toward removing, separating, or extracting the lead from the material. For example, a process known as the "Lime and Settle Treatment", which removes in excess of 90% of lead, Mercury, and zinc from waste water is utilized in the lead industry.

Another example may be seen in the recovery of lead from lead oxide by reducing lead oxide in the presence of carbon.

The reclamation of foundry sand and recovery of metals from waste foundry sand has been studied by G. V. Sullivan and E. G. Davis for the United States Bureau of Mines. The recovery of copper from brass foundry wastes, chromite from steel foundry sand, and the removal of phenolic resin binders is reported in their reference:

"Development and Economics of Treating a Brass Foundry Waste" by G. V. Sullivan and E. G. Davis Proceedings of The International Pollution Engineering Congress Paper delivered at McCormick Place, Chicago, IL, September 1974, Session 10, Page 59

The above reference discusses several techniques of recovering foundry sand and metals contained in it. Froth flotation, electrostatic separation, gravity concentration and standard ore processing techniques are included. The above reference indicates the economic benefits of recycling foundry sand and recovering copper from it.

The removal of hazardous contaminants, such as lead, when they are found in small concentrations in sand may not be economically viable, whereas metals which may appear in higher concentrations, such as copper, may be removed and employed.

The cost of removing hazardous contaminants, such as lead, which are found in small concentrations in sand may be greater than the value of the hazardous substance recovered. This invention is especially useful in this situation, where the sand can be made safe without removing the hazardous substance.

This invention may enable a cost saving to be realized in the disposal of a hazardous waste. The generally higher cost of directly disposing of a hazardous waste may be reduced to the generally lower cost of disposing of a non-hazardous waste after treatment by the subject process.

The combining of certain materials, particularly lead and its oxide forms, into silicon dioxide (silica) and silicates is well known in the ceramic arts. Lead, which is an environmentally hazardous substance, is added to glass in order to alter its properties. The resultant compositions are less soluble in aqueous solutions of acetic acid, and therefore environmentally safe. The addition of lead and lead compounds to glass can be used to change its melting point, index of refraction, coloration, and mechanical strength.

The production and application of glazing compounds makes use of the reduction of melting point caused by the addition of lead and other substances to glass.

The effects of temperature on the properties of various chemical combinations as their proportions are varied is found in:

"Phase Diagrams for Ceramists" by Ernest Levin, Howard McMundie, and F. P. Hall Ed. by American Ceramics Society, 1956, Page 59, FIG. 99, which shows the melting temperature of a mixture of lead oxide (PbO) and silicon dioxide ($SiO_2$) in a range from 100% PbO, 0% $SiO_2$ to 35% PbO, 65% $SiO_2$. This phase diagram shows that the melting point of PbO-SiO mixtures falls below 800° C. over a wide range of proportions. The melting point of pure PbO and pure $SiO_2$ is in excess of 800° C.

A process for treating an arsenic-containing waste to produce a landfill material impervious to the leaching effects of ground or rain waters is described in U.S. Pat. No. 4,142,912, issued Mar. 6, 1979, to Dean A. Young. The process described by Young requires materials to be added to the waste material and curing of the waste material into a rock-like aggregate.

OBJECTS OF THE INVENTION

The principal objects of the present invention is to provide a method of converting a hazardous waste material into a non-hazardous one. A non-hazardous waste material may be removed, relocated and reused more safely and economically than a hazardous waste. While the present invention is based on tests which show that soluble lead may be fixed insoluble onto waste foundry sand by roasting, it is possible that many other hazardous materials may be fixed upon their waste substrate or upon some added substrate by roasting.

Since roasting is a commonly used procedure for burning off organic impurities, it is another object of this invention to combine into one process step both the fixation of hazardous substances and the removal of organic contaminants. Anniston foundry sand, for example, contains organic contaminants which are a result of resins added to the sand to improve its properties for casting. These organic contaminants can be burned off by roasting during the same time as the lead is fixed upon the sand.

Another object of the present invention is the fixation of lead and other hazardous substances so that they may remain insoluble under natural environmental conditions. Other methods seek to remove, reclaim or recover the hazardous substance rather than fix it into the substrate of the waste material. Such other methods concentrate the hazardous substance for reuse or disposal whereupon it may later become a hazard to the environment and its inhabitants. Waste sand fixed by this process may be used safely as landfill material. Unlike the Young patent, cited above, the present invention does not require the addition of any materials so the waste sand nor does it require curing the material into a rock-like aggregate.

Another object of the present invention is the reduction of costs in the disposal of hazardous wastes. A cost saving is effected when the cost of treating the waste sand and disposing of it as a non-hazardous waste is less than the cost of disposing of it as a hazardous waste. Such a cost reduction may be realized with or without the benefit of revenues received for the sale of the material or any of its ingredients.

SUMMARY OF THE INVENTION

The present invention consists of a method of fixing toxic soluble lead contamination in waste foundry sand into a chemical combination with the sand itself so that it becomes insoluble in aqueous solutions of acetic acid. The method is comprised of roasting the waste sand at a temperature of about 800° C. for about 45 minutes. During the roasting process, lead reacts with the sand producing an acetic acid insoluble lead silicate. The reaction is a first order reaction where the rate of reaction is substantially directly proportional to the concentration of reacting substance.

Under these conditions the remaining reacting substance decreases exponentially from its original value. The linear rate constant, K, represents the natural logarithum of the ratio of remaining reacting substance to its original value per unit of time. At 800° C. the linear rate constant was found to be approximately $K=3.03$ exponential reductions per hour in reacting substance.

Each exponential reduction is a reduction by the factor $e=2.71828\ldots$, the base of the natural logarithums.

It is anticipated that the reaction rate constant, K varies with roasting temperature, such that a higher roasting temperature may result in a higher rate constant. The choice of roasting temperature in a full scale process plant for treating the waste foundry sand would take account of the effect of the temperature dependent reaction rate on through-put as well as on the cost and difficulty of maintaining that choice of roasting temperature.

It is further anticipated that the time period required for the roasting process to occur is generally in excess of the time period required for the burning off of organic impurities yet it is generally less than the time period required for kiln baking of ceramic glazes in the ceramic arts. Therefore, this process may fully incorporate the simultaneous process of burning off organic impurities while not requiring the time and investment characteristics of a ceramic arts process.

Waste foundry sand from the Phelps Dodge, Lee Brothers Brass Foundry in Anniston, Ala. (Anniston foundry sand) has been tested. These tests were conducted on selected samples of Anniston foundry sand whose test leachate ranged in contamination from 14 to 37 ppm of acetic acid soluble lead. These sand samples were subjected to roasting at a temperature of 800° C. for 15, 30, 45 and 60 minute periods, whereupon the acetic acid soluble lead contamination of the 37 ppm test leachate sample was reduced to 34, 7, 4 and 2 ppm, respectively. Since less than 5 ppm of lead was soluble in a test solution of acetic acid after 45 minutes of roasting at 800° C. it was shown that Anniston foundry sand can be made non-hazardous by this process. A longer residence time may be needed for lower roasting temperatures or for higher concentrations of acetic acid soluble lead.

A roasting temperature of 600° C. was selected for several tests which resulted in no signficant reduction of the acetic acid soluble lead concentration. Mixtures from 0 to 30% lead oxide in a system consisting of lead oxide and silicon dioxide are liquid phase at temperatures ranging from 710° C. to 890° C. Roasting at temperatures within or above this range results in the formation of lead silicate mixed with lead oxide and silicon dioxide which solidifies when cooled into an acetic acid insoluble vitreous or glassy substance fixed upon the surfaces of the sand particles. The lead becomes fixed onto the sand particles in a form which is insoluble to acqueous solutions of acetic acid. The roasting temperature selected for a full scale process plant may exceed the range of 710° C. to 890° C. in order to increase the reaction rate and through-put.

A rotary kiln, similar to those used in the manufacture of cement, is preferred for roasting the waste foundry sand. The rotary kiln allows the sand particles to come readily in contact with oxygen and heat, enabling the roasting process to proceed rapidly with large throughput of material. Other means for roasting, such as a multi-hearth furnace, fluidized bed roaster or batch loaded oven, may be used. Rotary kilns and batch loaded ovens are commonly used for ore processing, particularly roasting operations. This invention is not dependent on any particular type of roasting means, but the advantages of a rotary kiln are notable and it is identified as a preferred means of roasting. Alternatives to a rotary kiln may require more time and more energy to operate, which while effective, may be less economical.

What is claimed is:

1. A method of fixing hazardous concentrations of lead in waste sand comprising roasting the lead-containing sand at an elevated temperature for a period sufficient to chemically convert at least a portion of the lead to an acetic acid insoluble form.

2. The method of claim 1, and further wherein the roasting is carried out in an oxygen atmosphere.

3. The method of claim 1 or 2, and further wherein the acetic acid soluble lead concentration in the sand prior to roasting exceeds 5 ppm and subsequent to roasting is below 5 ppm.

4. The method of claim 3, and further wherein the roasting is conducted at a temperature of at least 710° C.

5. The method of claim 4, and further wherein the roasting is conducted at a temperature of approximately 800° C. for a period of approximately 45 minutes.

6. The method of claim 2, and further wherein the lead-containing sand contains further contaminants indigenous to the use of said sand in brass or bronze casting.

7. A sand composition having lead compounds therein, the total lead compounds being present in excess of 5 ppm but the acetic acid soluble lead compounds being present in no greater than 5 ppm.

* * * * *